US006984020B2

(12) United States Patent
Shinada et al.

(10) Patent No.: US 6,984,020 B2
(45) Date of Patent: Jan. 10, 2006

(54) INK JET PRINTING APPARATUS AND AN INK CARTRIDGE

(75) Inventors: Satoshi Shinada, Nagano-ken (JP); Koichi Toba, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 45 days.

(21) Appl. No.: 10/303,061

(22) Filed: Nov. 25, 2002

(65) Prior Publication Data

US 2003/0098902 A1 May 29, 2003

(30) Foreign Application Priority Data

Nov. 26, 2001 (JP) ..... 2001-359917

(51) Int. Cl.
*B41J 2/14* (2006.01)
*B41J 29/393* (2006.01)
*B41J 2/175* (2006.01)

(52) U.S. Cl. ..... 347/49; 347/19; 347/86

(58) Field of Classification Search ..... 347/19, 347/49, 85, 86, 87

See application file for complete search history.

(56) References Cited

U.S. PATENT DOCUMENTS 6,158,837 A * 12/2000 Hilton et al. ..... 347/19
6,332,481 B1 * 12/2001 Shinada et al. ..... 141/18
6,345,891 B1 * 2/2002 Childers et al. ..... 347/87
6,722,762 B2 * 4/2004 Miyazawa et al. ..... 347/86
2002/0154200 A1 10/2002 Miyazawa et al.
2002/0158948 A1 10/2002 Miyazawa et al.
2003/0107627 A1 6/2003 Seino et al.

FOREIGN PATENT DOCUMENTS

EP 0 997 297 A1 5/2000
EP 1 199 179 A1 4/2002
EP 1208988 A1 * 5/2002
WO WO 99/59823 11/1999

* cited by examiner

*Primary Examiner*—Anh T. N. Vo
(74) *Attorney, Agent, or Firm*—Sughrue Mion, PLLC

(57) ABSTRACT

An ink jet printing apparatus which prints in various colors of ink, including: a ink cartridge mounting section which is selectively and detachably equipped with a plurality of separate ink cartridges or an integrated ink cartridge, wherein each of the plurality of separate ink cartridges comprises an ink chamber for storing ink of a color separately and an information storing member for storing information on the ink stored, and the integrated ink cartridge comprises a plurality of ink chambers for respectively storing ink of respective colors and an information storing member for storing information on all of the ink of respective colors; and an information acquiring section for acquiring the information on all of the ink of respective colors from the information storing member formed in the integrated ink cartridge.

16 Claims, 8 Drawing Sheets

INK JET PRINTING APPARATUS AND AN INK CARTRIDGE

The present application claims priority from a Japanese Patent Application No. 2001-359917 filed on Nov. 26, 2001, the contents of which are enclosed herein by reference.

BACKGROUND OF THE INVENTION

1. Field of the Invention

The present invention relates to an ink jet printing apparatus and an ink cartridge. More particularly, the present invention relates to an ink jet printing apparatus which prints in various color of inks and an ink cartridge therefor.

2. Description of the Related Art

According to a conventional ink jet printing apparatus, an ink cartridge for supplying ink to the main body side of the ink jet printing apparatus is detachably mounted on a carriage, which has an ink jet print head. As one of the conventional ink jet printing apparatus, there has been known a so-called color ink jet printing apparatus which can print in various color ink.

Colors conventionally used for the color ink may include, for example, four colors consisting of black, cyan, magenta and yellow. An example of configuring the ink cartridge for ink of these four colors uses four separate ink cartridges each of which stores ink of one of the four colors. An IC chip, which contains and holds information on the ink stored in each ink cartridge, is provided on each of the conventional ink cartridges. The information on the ink includes information relating to an existence of ink cartridge, the color of ink accommodated therein, the remaining amount of ink, the type or model of ink and so on.

In this case, the ink jet printing apparatus is provided with an information reading-out section on a position facing the IC chip of the respective ink cartridge. The printing apparatus reads out information on ink from the IC chip through the reading-out section. In the ink jet printing apparatus which is equipped with four (4) separate cartridges, each of four (4) separate information reading-out sections is provided on a position corresponding to the respective one of the four separate IC chips. Based on information read out from the IC chip through the information reading-out section, the ink jet printing apparatus performs, for example, appropriate printing with ink of various colors.

On the other hand, there has been another example of the conventional ink cartridge such as a single, integrated ink cartridge which has four separate chambers. The IC chip for the integrated ink cartridge is different from that for the separate-type ink cartridge for each color. Moreover, since the information reading-out section of the carriage reads out information on ink from the IC chip of the integrated ink cartridge, structure of the information reading-out section in the carriage is also different from that of the information reading-out section in the carriage which is equipped with the separate ink cartridges.

Therefore, if the integrated ink cartridge is used for the printing apparatus having the carriage designed for mounting the separate ink cartridges, the hardware structure of the carriage needs modifying.

However, it is inconvenient to replace the carriage itself. Especially, the carriage connects to the body of the printing apparatus mechanically and electrically, and is usually adjusted with high positional accuracy with respect to the printing apparatus body and the ink cartridge in particular the electrical contact members of the IC chip, so that an extremely high printing quality can be realized. Therefore, it is very difficult for a user of the printing apparatus to replace the carriage.

SUMMARY OF THE INVENTION

Therefore, it is an object of the present invention to provide an ink jet printing apparatus and an ink cartridge thereof which are capable of overcoming the above drawbacks accompanying the conventional art. The above and other objects may be achieved by combinations described in the independent claims. The dependent claims define further advantageous and exemplary combinations of the present invention.

According to the first aspect of the present invention, an ink jet printing apparatus for printing in various colors of ink, includes a container which is selectively and detachably equipped with a plurality of separate ink cartridges or an integrated ink cartridge, wherein each of the plurality of separate ink cartridges includes an ink chamber for storing ink of a color separately and an information storing member for storing information on the ink stored, and the integrated ink cartridge includes a plurality of ink chambers for respectively storing ink of respective colors and an information storing member for storing information on all of the ink of respective colors; and an information acquiring section for acquiring the information on all of the ink of respective colors from the information storing member formed in the integrated ink cartridge.

In an ink jet printing apparatus the information storing member of the integrated ink cartridge is provided on a location of a main body of the ink cartridge corresponding to a location where the information storing member of one of the plurality of ink cartridges is provided.

In an ink jet printing apparatus, the integrated ink cartridge includes a unit to be detected indicating that each of the ink chambers of respective colors is present, wherein the unit to be detected is provided on a location corresponding to a location where the information storing member of another ink cartridge of the plurality of ink cartridges is provided.

In an ink jet printing apparatus, the information acquiring section further includes a detecting unit for determining whether or not each of the plurality of ink cartridges in case of the plurality of ink cartridges or each of the ink chambers of respective colors in case of the integrated ink cartridge, exists on a location facing the information storing member and the unit to be detected provided on each ink cartridge of the plurality of ink cartridges.

In an ink jet printing apparatus, the information acquiring section detects the information storing members of the plurality of ink cartridges in a predetermined order, and the information storing member is provided on a location corresponding to a location where the information storing member detected by the printing apparatus for the first time is located.

In an ink jet printing apparatus, the information acquiring section determines whether the ink cartridge is one of the plurality of ink cartridges for respective colors or the integrated ink cartridge, and changes coming process according to the determination result.

In an ink jet printing apparatus, the information acquiring section connects to an information reading-out section, which reads out information from the information storing member of the plurality of ink cartridges, in parallel, and may read out and store information on respective colors by using identification information on respective colors.

In an ink jet printing apparatus, the information acquiring section includes an information reading-out section which reads out the information from the information storing member of the integrated ink cartridge in the same order as in case the information on ink of respective colors of the plurality of ink cartridges is read out.

In an ink jet printing apparatus, the information acquiring section includes a type determining section for determining whether the plurality of ink cartridges or the integrated ink cartridge is equipped.

According to a second aspect of the present invention, an ink cartridge for being provided to an ink jet printing apparatus, which can print in various colored ink and may be equipped with a plurality of separate ink cartridges respectively storing ink of a plurality of colors, includes a main body of integrated ink cartridge formed to be integrated as a whole for including a plurality of ink chambers respectively storing the ink of plurality of colors; and an information storing member provided in the main body of the ink cartridge for including information corresponding to information included in each of the plurality of separate ink cartridges.

In an ink cartridge, the information storing member is provided on a location corresponding to a location where information storing member of one of the plurality of separate ink cartridges is provided.

In an ink cartridge further includes a unit to be detected indicating that each of the ink chambers of respective colors is present, wherein the unit to be detected is provided on a location corresponding to a location where an information storing member of another ink cartridge of the plurality of ink cartridges is provided.

In an ink cartridge, the information storing member is provided on a location corresponding to a location where the information storing member detected by the printing apparatus for the first time is located.

In an ink cartridge, the information storing member includes information indicating that whether the ink cartridge equipped with the information storing member is one of the plurality of separate ink cartridges or the integrated ink cartridge.

In an ink cartridge, the information storing member can acquire and store information on ink for each color by using identification information of ink of each color.

The summary of the invention does not necessarily describe all necessary features of the present invention, and The present invention may also be a sub-combination of the features described above.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
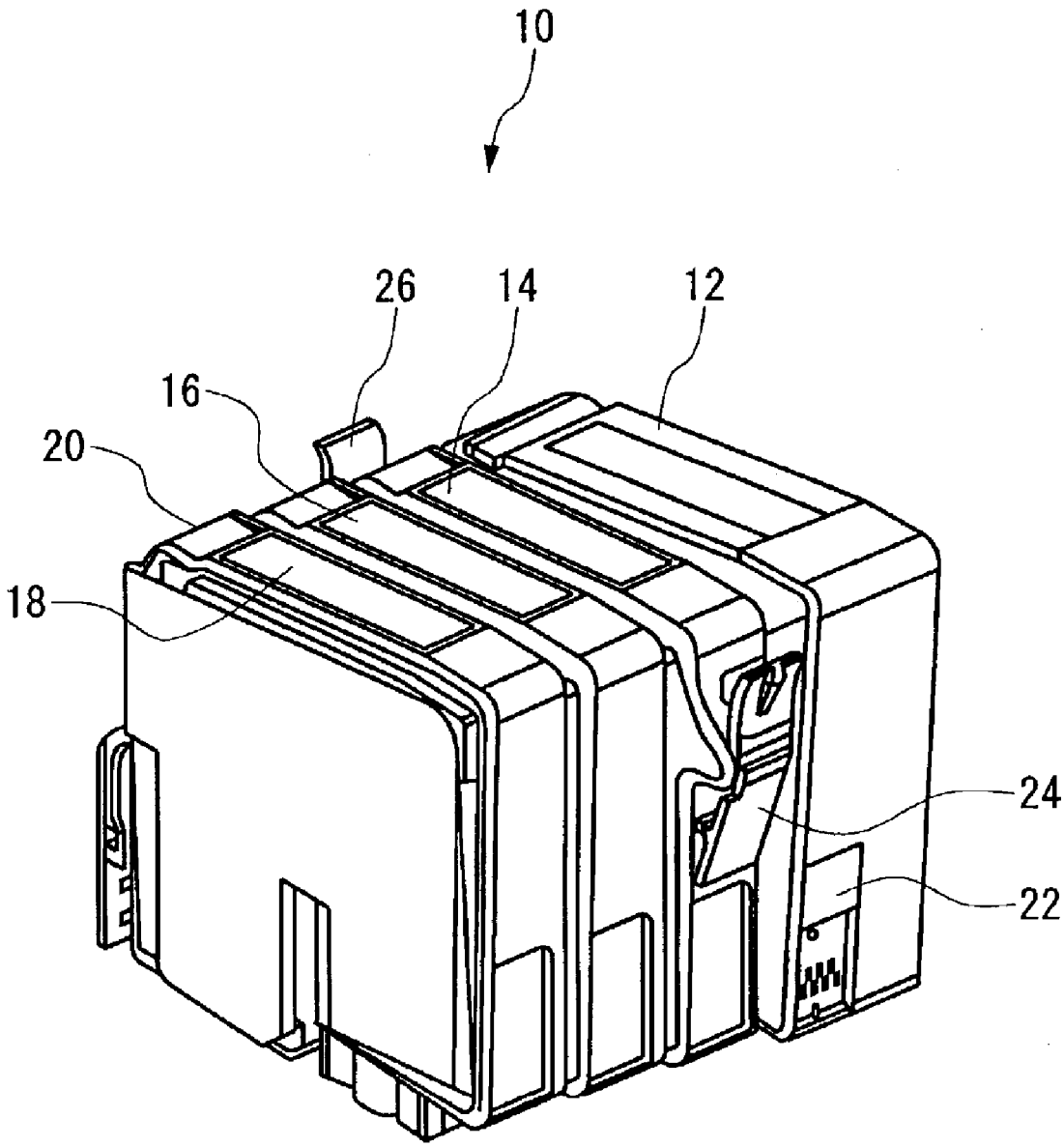
FIG. 1 shows an elevational view of an integrated ink cartridge according to a first embodiment of the present invention.

FIG. 1 is a perspective view showing an integrated ink cartridge according to a first embodiment of the present invention. An integrated ink cartridge 10 includes a main body 20 which includes a plurality of independent chambers 12, 14, 16 and 18 each storing different color of ink, and an information storing member 22 such as an IC chip provided on a predetermined position of the main body 20. Further, a first and a second engaging members 24 and 26, which engage with a part of a carriage of the ink jet printing apparatus, are formed in integral with the main body 20 of the ink cartridge on the upper part of front and rear sides of the ink chamber 14 of the main body 20 of the ink cartridge 10. The first and second engaging members 24 and 26 have the same structures with those of the first and second engaging members for the separate ink cartridges for respective colors.

Figure 2:
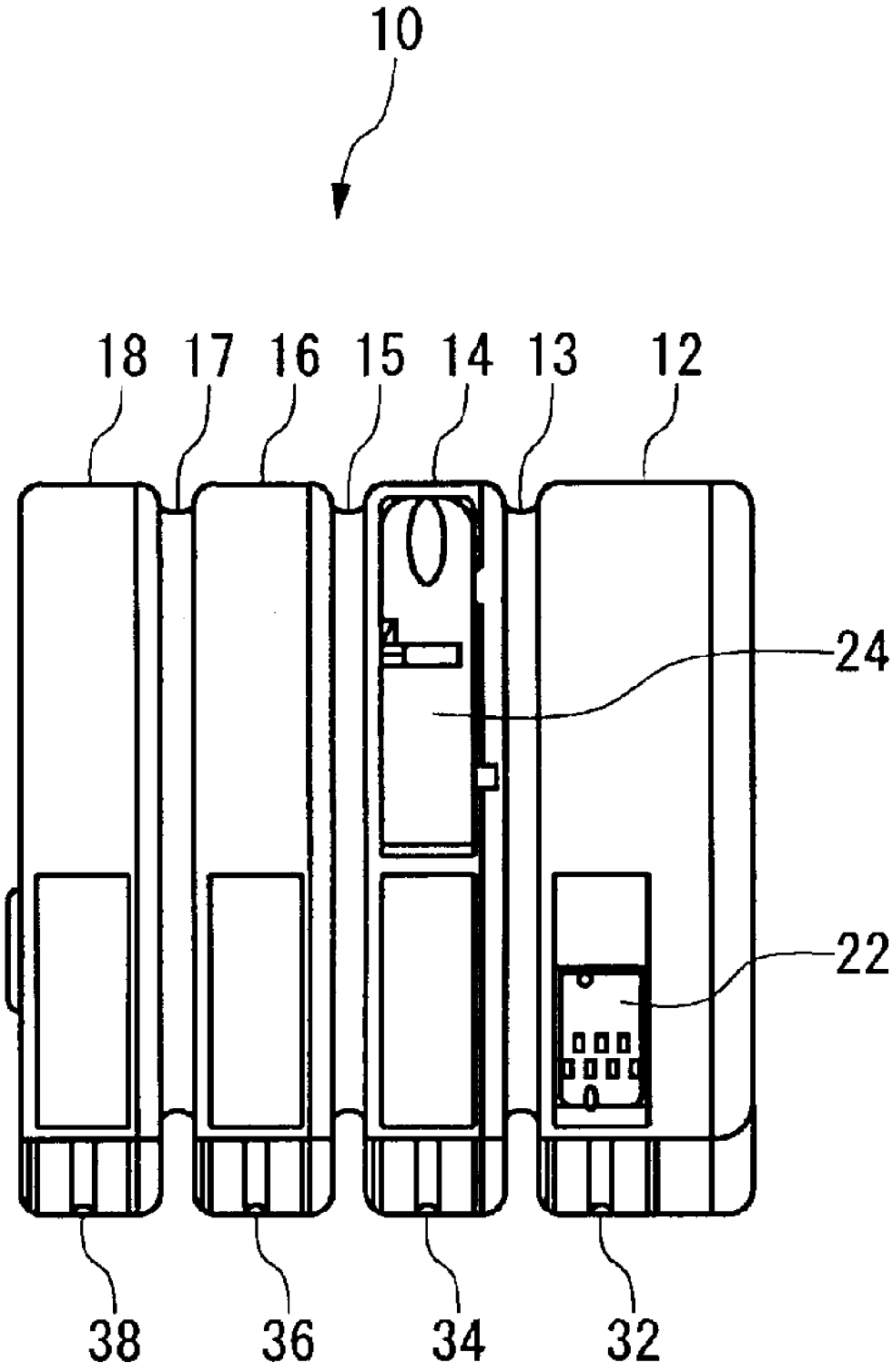
FIG. 2 shows a front view of the integrated ink cartridge shown in FIG. 1.

FIG. 2 is a front view showing the integrated ink cartridge 10 shown in FIG. 1. The ink chamber 12, according to the first embodiment of the present invention, is greater in volume than the other chambers, and accommodates black ink. The other ink chambers 14, 16 and 18 contain cyan, magenta and yellow ink, respectively. According to the ink cartridge 10 of the present embodiment, ink is impregnated and held in a porous member, not shown, housed in the ink chamber 12, 14, 16 or 18. Ink supply ports 32, 34, 36 and 38 are formed on bottoms of the ink chambers 12, 14, 16 and 18, respectively. Appearance of each ink chamber 12, 14, 16 or 18 is almost the same as that of the ink chamber of the separate-type ink cartridge for each color. For example, in the case of the integrated ink cartridge corresponding to the separate ink cartridges, each of which has its own appearance, for various colors in order to prevent insertion error, each ink chamber has almost the same appearance with that of each separate ink cartridge for each color.

These ink chambers 12, 14, 16 and 18 connect to one another by connection parts 13, 15 and 17, and thus the main body 20 of the ink cartridge 10 is designed to be integrated as one unit. The ink chambers 12, 14, 16 and 18 and the connection parts 13, 15 and 17 for connecting the ink chambers 12, 14, 16 and 18 of the main body 20 of the ink cartridge 10 according to the present embodiment are formed by an integral injection molding process. Each connection part 13, 15 and 17 has a width so that each ink chamber 12, 14, 16 or 18 can be properly installed on a corresponding location of the carriage 40 in case the integrated ink cartridge 10 is mounted on the carriage 40 of the ink jet printing apparatus.

The IC chip 22, serving as an example of the information storing member, is provided on the front side of the ink chamber 12. The IC chip 22 of the integrated ink cartridge is disposed on a location of the main body 20 of the ink cartridge corresponding to the location where an IC chip for one of the separate ink cartridges is installed. According to the present embodiment, the IC chip 22 of the integrated ink cartridge 10 is provided on the same location with the location where the IC chip of the black ink cartridge is installed. IC chip 22 of the present embodiment has a memory device such as a semiconductor memory device and has two-rowed contact terminals, where three (3) terminals are on the upper row and four (4) terminals are on the lower row. The arrangement and number of terminals of the IC chip 22 is the same as those of IC chip mounted on the black ink cartridge in case of the separate ink cartridges. Therefore, without changing hardware specification in the main body side of the printing apparatus, it is possible to read out the information from the IC chip 22 of the integrated ink cartridge 10. In addition, according to the present embodiment, no IC chip is mounted on the front side of the other ink chamber 14, 16 or 18.

Though the IC chip 22 according to the present embodiment is provided with the contact terminals for a communication, the invention is not limited thereto or thereby. For example, a con-contact type communication device or system may also be employed if desired, such as an optical communication system or electromagnetic communication system.

According to the integrated ink cartridge of the present embodiment, the IC chip 22 is installed on a location corresponding to a location where an IC chip recognized for the first time out of a plurality of IC chips for a plurality of ink cartridges is installed. However, the scope of the present invention is not limited to this.

For example, in case that the IC chip is installed on the front side of the ink chamber 14 for the integrated ink cartridge 10, it is difficult to be influenced by the installation inclination of the integrated ink cartridge because it is possible to provide the IC chip substantially in the middle of the integrated ink cartridge 10 in the direction of the width. Furthermore, since it is possible to provide the IC chip in the vicinity of the first engaging member, the IC chip is kept in stable connection with connecting section of the carriage.

This IC chip 22 includes information corresponding to information included by each of a plurality of separate ink cartridges. The information included by each of a plurality of separate ink cartridges includes information on existence of the ink cartridge, color of stored ink in the ink cartridge, the remaining amount of ink and etc. The IC chip 22 of the present embodiment includes information on color of the ink stored in each ink chamber and remaining amount of the ink in each ink chamber. Moreover, the IC chip 22 also includes type determining information which indicates that a present cartridge is an integrated ink cartridge 10 including black, cyan, magenta and yellow ink chambers.

Figure 3:
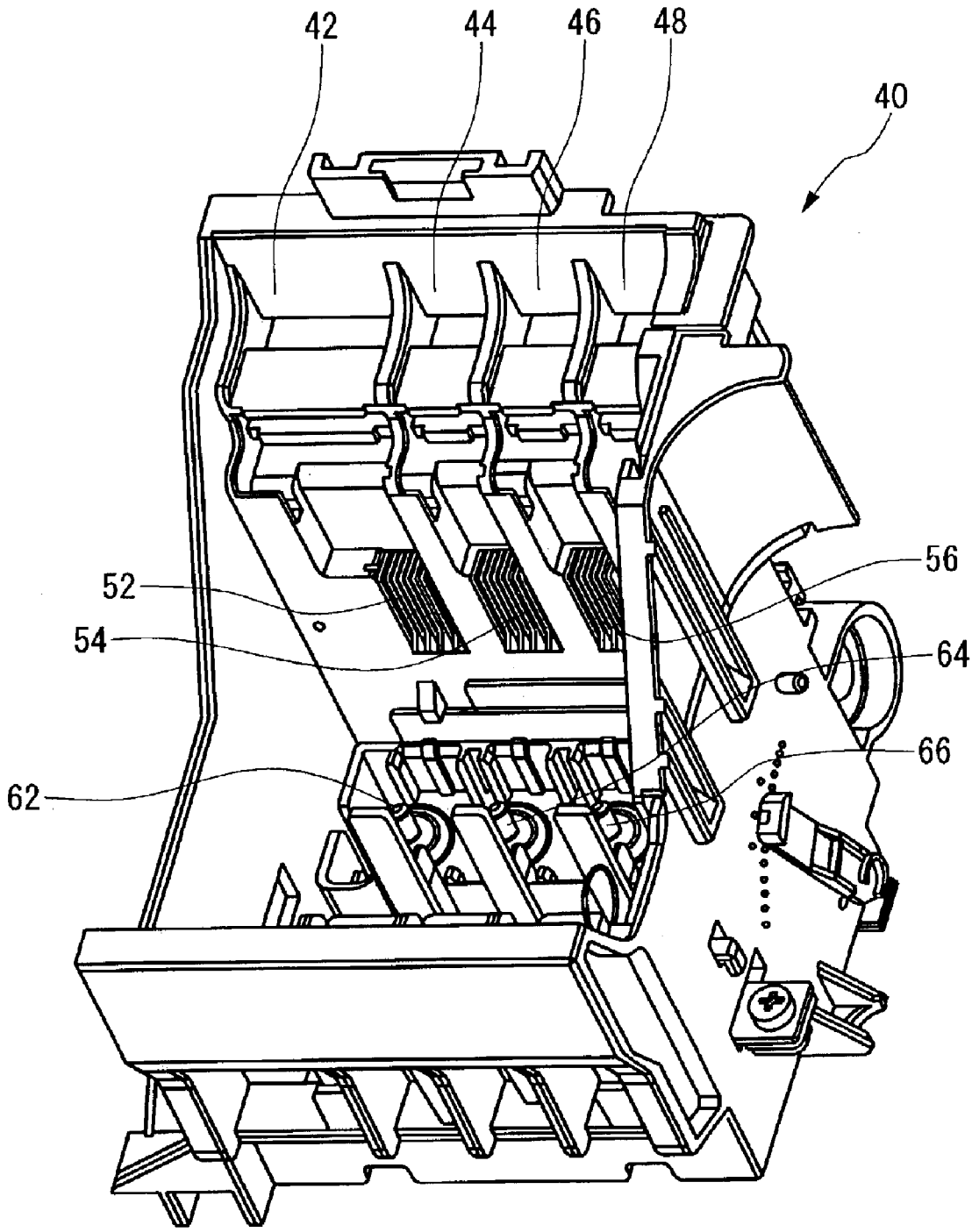
FIG. 3 shows an elevational view of a carriage of an ink jet printing apparatus according to the first embodiment of the present invention.

FIG. 3 is a perspective view showing a carriage of an ink jet printing apparatus to which the first embodiment of the present invention is applied. Separate-type ink cartridges respectively storing ink of various colors are provided in the carriage 40. The carriage 40 of the present embodiment includes a first mounting section 42 in which the black ink cartridge is contained, a second mounting section 44 in which the cyan ink cartridge is contained, a third mounting section 46 in which the magenta ink cartridge is contained and the fourth mounting section 48 in which the yellow ink cartridge is contained, starting from the left.

The first mounting section 42 of the carriage 40 includes a first information reading-out section 52, which reads out the information from the IC chip, on a location facing the IC chip provided on the black ink cartridge. Similarly, the second, third and fourth mounting sections 44, 46 and 48 includes a second, a third and a fourth information reading-out sections 52, 54 and 58 on locations facing the IC chips provided on cyan, magenta and yellow ink cartridges, respectively. According to the present embodiment, each of the first to fourth information reading-out sections 52, 54, 56 and 58 is preferably a contact-type information reading-out section which receives and sends information by contacting with corresponding terminal of the IC chip.

The first mounting section 42 of the carriage 40 includes a first ink supply needle 62 on a location of its bottom corresponding to the ink supply path of the black ink cartridge. When the black ink cartridge is provided in the first mounting section 42, the first ink supply needle 62 advances to the black ink supply path, and the black ink is supplied to the body of the ink jet printing apparatus. In the same manner, the second, third and fourth mounting sections 44, 46 and 48 includes a second, a third and a fourth ink supply needles 64, 66 and 68 on locations corresponding to cyan, magenta and yellow ink cartridges, respectively.

Figure 4A:
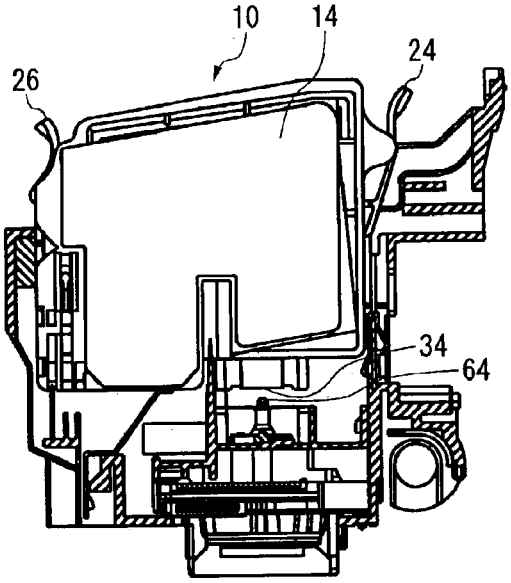
FIGS. 4A to 4D show cross sectional views illustrating a method for installing the integrated ink cartridge into the carriage.
Figure 4B:
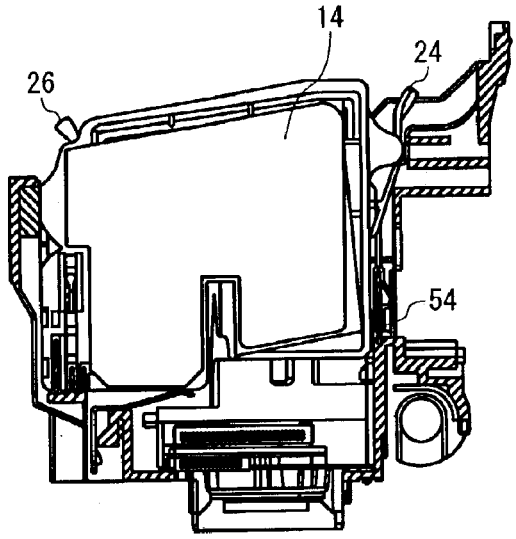
Figure 4C:
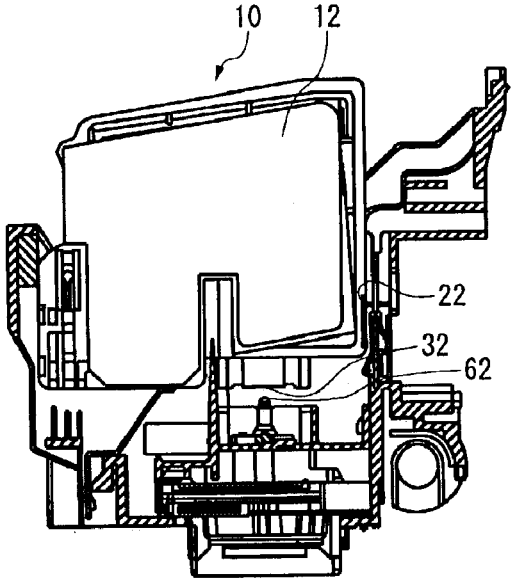
Figure 4D:
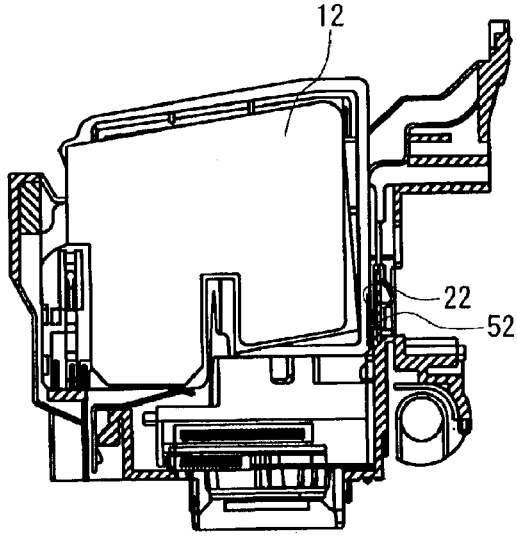

FIGS. 4A to 4D show cross sectional views illustrating a method for installing the integrated ink cartridge into the carriage 40. FIGS. 4A and 4B show cross sectional views illustrating a method for installing the cyan ink chamber 14 of the integrated ink cartridge 10, and FIGS. 4C and 4D show cross sectional views illustrating a method for installing the black ink chamber 12 of the integrated ink cartridge 10.

First, the integrated ink cartridge 10 is mounted from the top of the carriage 40. In this case, the ink chamber 14 storing cyan ink, which is arranged on a location corresponding to the separate cyan ink cartridge and has almost the same appearance as that of the separate cyan ink cartridge, is inserted into the second mounting section 44 as shown in FIG. 4A. When the integrated ink cartridge 10 is inserted further, the ink supply needle 64 of the second mounting section 44 is inserted to the ink supply path 34 on the bottom of the cyan ink chamber 14. Further, as shown in the FIG. 4B, the first and second engaging members 24 and 26, which are installed on the front and rear sides of the cyan ink chamber 14, are engaged with the carriage 40 like when the separate cyan ink cartridge is inserted. By this, the integrated ink cartridge 10 is settled in the carriage 40.

As the cyan ink chamber 14 of the integrated ink cartridge 10 is inserted into the second mounting section 44 of the carriage 40, as shown in FIG. 4A, the black ink chamber 12 is also inserted into the first mounting section 42 of the carriage 40, as shown in FIG. 4C. If the integrated ink cartridge is inserted further, the ink supply needle 62 of the first mounting section 42 is inserted into the ink supply path 32 on the bottom of the black ink chamber 12. Unlike the case of the separate black ink cartridge, the engaging member is not installed on the front and rear sides of the black ink chamber 12 of the present embodiment. However, the black ink chamber 12 connects to the cyan ink chamber 14 with the connection part 13. Therefore, the black ink chamber 12 is settled in the carriage 40, as shown in FIG. 4D, by the first and second engaging members 24 and 26 engaged with the carriage 40, as shown in FIG. 4B.

In addition, each of the magenta and yellow ink chambers 16 and 18 is mounted onto each of the third and fourth mounting sections 46 and 48, in the same manner. In this way, the carriage 40 can be equipped with the integrated ink cartridge 10 in the place where a plurality of separate ink cartridges are equipped.

As shown on FIG. 4D, the first information reading-out section 52 in the first mounting section 42 of the carriage 40 is in contact with the IC chip 22 provided on the black ink chamber 12 of the integrated ink cartridge 10, while the carriage 40 is equipped with the integrated ink cartridge 10. Therefore, according to the present embodiment, the first information reading-out section 52 functions as an information reading-out section for reading out information on ink of all four colors, such as black, cyan, magenta and yellow, of the integrated ink cartridge from the IC chip 22.

Figure 5:
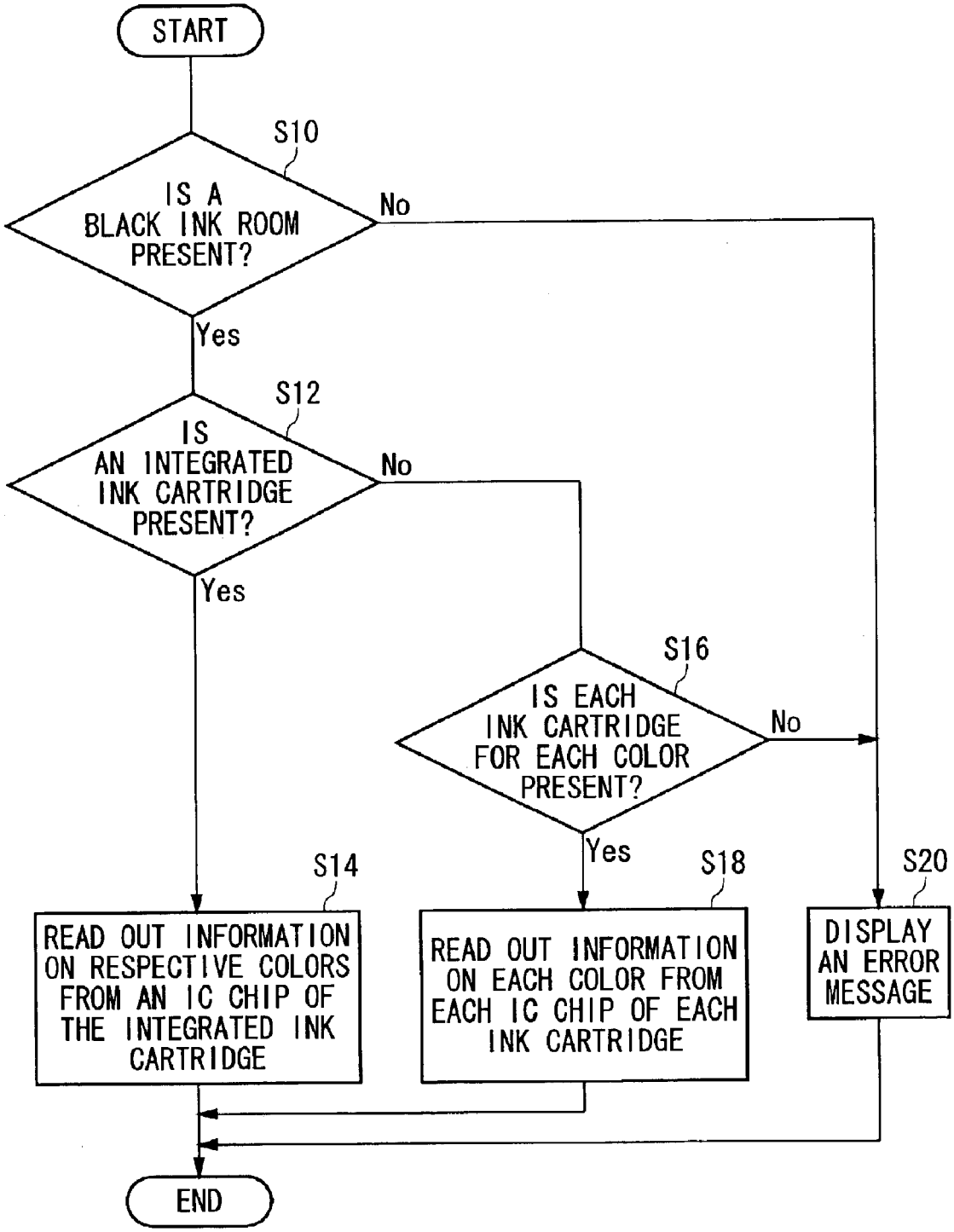
FIG. 5 is a flowchart illustrating a method for reading out information on each color from the ink cartridge.

FIG. 5 is a flowchart illustrating a method by which the main body of the ink jet printing apparatus reads out information on each color from the plurality of separate ink cartridges or the integrated ink cartridge 10.

When reading out flow starts, it is detected whether or not an ink room of the black ink exists. Hereinafter, an "ink chamber" means either one of the ink chambers 12, 14, 16 and 18 in case of the integrated ink cartridge 10 and ink cartridge itself in case of the separate ink cartridge for ink of each color.

In case the black ink chamber is detected, it is determined whether or not the ink cartridge provided to the first mounting section 42 of the carriage 40 is the integrated ink cartridge 10. Here, the IC chip 22 of the integrated ink cartridge 10 includes type-determining information which indicates that the ink cartridge is the integrated ink cartridge. According to the present embodiment, a type determining section is arranged in the main body of the ink jet printing apparatus, and distinguishes which ink cartridge out of the plurality of separate ink cartridges and the integrated ink cartridge is now provided based on the information read out by the first information reading-out section 52 from the IC chip 22. In case the type determining information indicating that the ink cartridge is the integrated ink cartridge is read out from the IC chip 22, the type determining section determines that the ink cartridge provided is the integrated ink cartridge. Otherwise, in case the type-determining information is not read out from the IC chip, it is determined that the ink cartridge provided is not the integrated ink cartridge. Alternatively, in case another type-determining information indicating that the ink cartridge is a separate black ink cartridge is read out from the IC chip 22, the type determining section may determine that the ink cartridge is not the integrated ink cartridge.

The main body of the ink jet printing apparatus may determine whether the information storing member recognized for the first time is that for the separate ink cartridges or for the integrated ink cartridge, and change coming process according to the determination result.

In case the ink cartridge now provided to the carriage 40 is determined to be the integrated ink cartridge 10, the first information reading-out section 52 reads out information on each color from the IC chip 22. That is to say, the first information reading-out section 52 reads out information corresponding to information of each of the plurality of separate ink cartridges from the IC chip 22. In this case, the first information reading-out section 52 reads out information from the IC chip 22 of the integrated ink cartridge 10 in the same order as information on ink of the plurality of colors are read out of the plurality of separate ink cartridges. For example, in case the information reading-out section reads out the information on ink colors from the IC chips of the plurality of separate ink cartridges in the order of black, cyan, magenta and yellow, the information from the IC chip of the integrated ink cartridge 10 is also read out in the order of black, cyan, magenta and yellow. Therefore, it is possible to print in a plurality of colors with the integrated ink cartridge as with the plurality of separate ink cartridges for various colors.

In case it is detected that the black ink chamber exists and the ink cartridge is not the integrated ink cartridge (step S12), it is detected whether or not each ink cartridge for each color exists (step S16). That is to say, it is detected whether or not each ink cartridge of cyan, magenta or yellow is provided to the carriage 40. It is determined whether or not each ink cartridge exists by each of the second to fourth information reading-out sections 54, 55 and 56 detecting IC chip of each ink cartridge. Here, the second to fourth information reading-out sections 54, 55 and 56 functions as detecting units respectively detecting whether or not the separate ink cartridges exist. If it is determined that all the color ink cartridges exist, each of the first to fourth information reading-out sections 52, 54, 56 and 58 reads out information on each color from each IC chip (step S18). As described above, according to the present embodiment, the readout information from the IC chip is read out in the order of black, cyan, magenta and yellow. Therefore, it is possible to print in a plurality of colors with the separate ink cartridges for various colors.

In addition, if it is determined that the black ink chamber does not exist (step S10) and any one of the plurality of separate ink cartridges does not exist (step S16), an error message is displayed and the reading out process ends.

According to the first embodiment of the present invention, it is possible to print in various colored ink without changing hardware structure by providing the integrated ink cartridge which includes a plurality of ink chambers of various colors to the ink jet printing apparatus to which the plurality of separate ink cartridges can also be provided. Moreover, it is also possible to reduce cost by reducing the number of elements since one IC chip has information on every color though there is a plurality of ink chambers.

Figure 6:
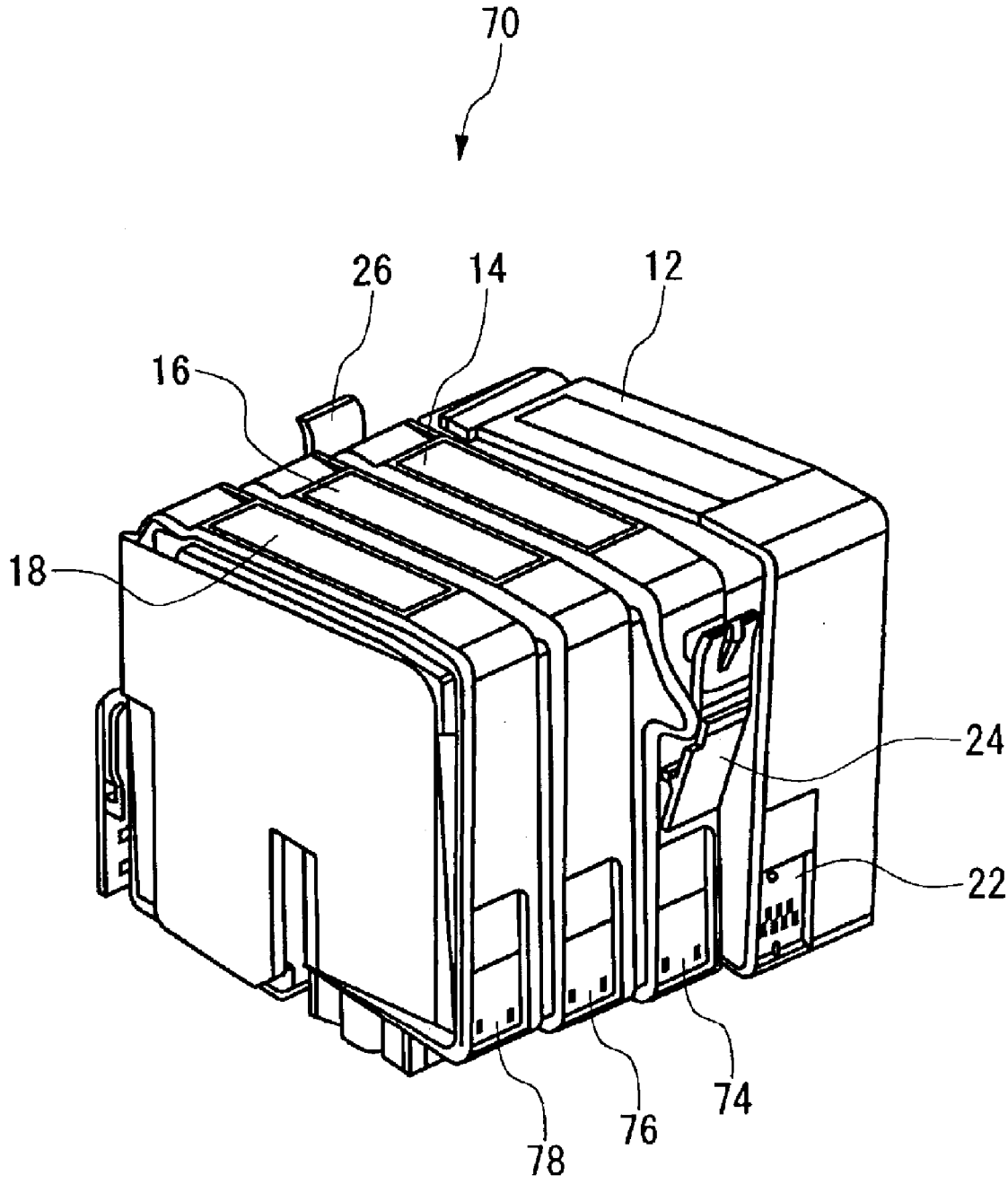
FIG. 6 shows an elevational view of an integrated ink cartridge according to a second embodiment of the present invention.

FIG. 6 shows an elevational view of the integrated ink cartridge 70 of a second embodiment of the present invention. The integrated ink cartridge 70 is almost the same structure as the ink cartridge 10 of the first embodiment, so that the same elements have the same reference numbers and the detailed description of the same elements are omitted.

The integrated ink cartridge 70 of the second embodiment includes detecting IC chips 74, 76 and 78, which indicates that ink chambers 14, 16 and 18 of various colored ink are present, on locations corresponding to the locations where the IC chips except one for the black ink are installed on separate ink cartridges. Each detecting IC chip 74, 76 or 78 of the present embodiment includes a base plane, two (2) exposed terminals on the surface of the base plane and a connecting unit electrically connected to the two terminals on the base plane.

Figure 7:
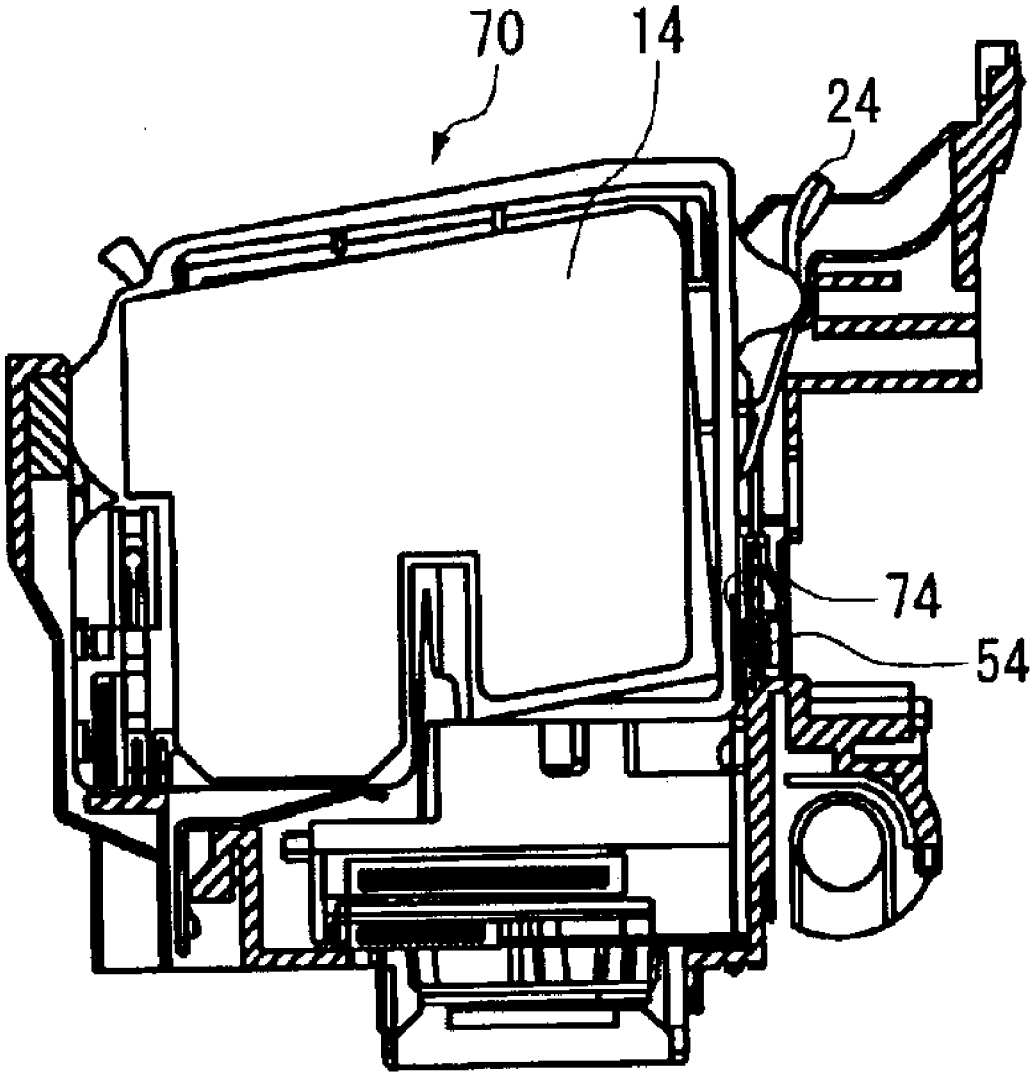
FIG. 7 shows a cross sectional view illustrating a method for equipping the integrated ink cartridge shown in FIG. 6 into the carriage.

FIG. 7 shows across sectional view of the carriage 40 equipped with the integrated ink cartridge 70. In FIG. 7, the same elements with those shown in FIG. 4B have the same reference numbers, and the detailed description for those elements are omitted.

The integrated ink cartridge 70 is installed on the carriage 40 which is the same with that of the first embodiment. When the integrated ink cartridge 70 is installed on the carriage 40, terminals of each detecting IC chip 74, 76 or 78 provided on each ink chamber 14, 16 or 18 of cyan, magenta or yellow are contacted with each of the second to fourth information reading-out sections 54, 56 and 58, which is different from the case of the first embodiment. As shown in FIG. 7, for example, terminals of the detecting IC chip 74 provided on the cyan ink chamber 14 is contacted to the second information reading-out section 54. The second to fourth information reading-out sections 54, 56 and 58 function as detecting units for detecting respective ink chambers provided on locations corresponding to IC chips on respective ink cartridges. In case of the plurality of separate ink cartridges, the second to fourth information reading-out sections 54, 56 and 58 function also as detecting units for detecting respective ink cartridges.

Figure 8:
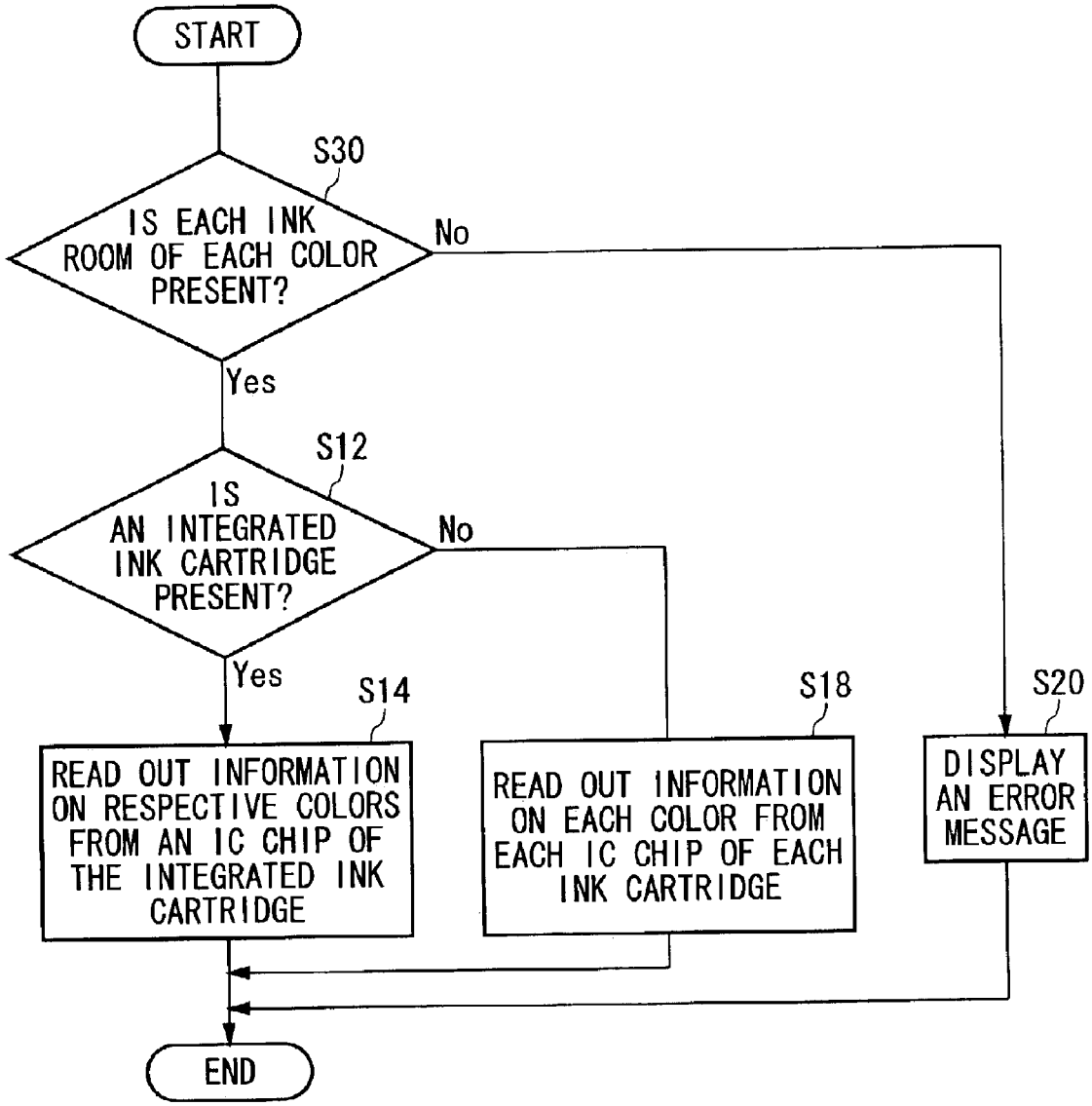
FIG. 8 is a flowchart illustrating a method for reading out information on each color from the ink cartridge.

FIG. 8 is a flowchart illustrating a method in which an ink jet printing apparatus reads out information on each color from the separate ink cartridge or the integrated ink cartridge 70. The same steps of the flowchart in FIG. 8 with those in FIG. 5 have the same reference numbers, and detailed descriptions of them are omitted.

When reading out process starts, it is determined whether or not each ink chamber for each color ink exists on the carriage 40. According to the present embodiment, each of the first to fourth information reading-out sections 52, 54, 56 and 58 determines whether or not the ink chamber for each color ink exits by detecting each IC chip provided on black, cyan, magenta or yellow ink cartridge in case of separate ink cartridges or by detecting the information IC chip 22 of the black ink chamber 12 or the detecting IC chips 74, 76 or 78 of the cyan, magenta or yellow ink chambers 14, 16 or 18.

If it is determined that all ink chambers for respective colors exist, it is further determined whether or not the ink cartridge provided on the carriage 40 is the integrated ink cartridge (step S12). If it is determined that the ink cartridge is the integrated ink cartridge, information on each color is read out from the IC chip 22 (step S14). If it is determined that the ink cartridge is not the integrated ink cartridge, information on each color is read out from each IC chip (step S18).

Moreover, if it is determined that there is no ink chamber, an error message is displayed (step S20) and the reading out process ends. According to the second embodiment of the present invention, it is possible to achieve the same result as in the case of the first embodiment. Furthermore, according to the second embodiment, since information is read out from the detecting IC chips provided on respective ink chambers, it is also possible to confirm surely that each ink chamber of the integrated ink cartridge is installed on predetermined locations of the carriage. For example, it may be possible to detect that the integrated ink cartridge is tilted.

According to the first and second embodiments, the ink is stored and maintained in a porous material contained in the ink chamber, but the present invention is not limited to this. As for another example, the ink may be stored and maintained by a valve unit generating differential pressure.

According to the first and second embodiments, the ink cartridge includes respective ink chambers and connection parts for connect the ink cambers together, which are fabricated by an integral molding process. However, the present invention is not limited to this, and the integrated ink cartridge may be formed by molding the ink chambers separately and connecting the chambers with the connection parts to form integrated structure.

Moreover, according to the ink cartridge of the first or second embodiment, an engaging member is provided to one of the ink chambers. However, the present invention is not limited to this, and more than one ink chambers may be provided with the engaging members.

Further, according to the first and second embodiments, the information reading-out section reads out and sends information from/to the IC chips by contacting with each other, but the present invention is not limited to this. As for another example, the information reading-out section reads out and sends information from/to the IC chip without physical contact with the IC chip.

In addition, an information acquiring section may be in parallel contact with an information reading-out section, which reads out information from information storing member of the ink cartridge, read out and store information on respective colors by using identification information of respective colors.

It is apparent from the above description, according to the present invention, it is possible to print in various colored ink without changing hardware structure by providing the integrated ink cartridge which includes a plurality of ink chambers of various colors to the ink jet printing apparatus to which the plurality of separate ink cartridges can also be provided.

Although the present invention has been described by way of exemplary embodiments, those exemplary embodiments do not limit the scope of the present invention. Many changes and substitutions may be added to the above embodiments. It is clear from the appended claims that those change and substitution added forms are inside the scope of the present invention.

What is claimed is:

1. An ink jet printing apparatus for printing in various colors of ink, comprising:

an ink cartridge mounting section which is capable of selectively and detachably mounting, individually, both of a plurality of separate ink cartridges, wherein each of said plurality of separate ink cartridges comprises an ink chamber for separately accommodating a different color of ink, respectively, and an information storing member for storing information relating to said ink, and an integrated ink cartridge, wherein said integrated ink cartridge comprises a plurality of ink chambers for respectively accommodating a different color of ink and an information storing member for storing information relating to all of said inks accommodated in each of said ink chambers; and an information acquiring section for acquiring said information on all of said ink of respective colors from said information storing member mounted on said integrated ink cartridge.

2. An ink jet printing apparatus as claimed in claim 1, wherein said information storing member of said integrated ink cartridge is provided on a predetermined location of a main body of said ink cartridge corresponding to a location where said information storing member of one of said plurality of ink cartridges is provided.

3. An ink jet printing apparatus as claimed in claim 2, wherein said integrated ink cartridge comprises a portion to be detected indicating that all of said ink chambers of different colors exists, and said portion to be detected is provided on a location corresponding to a location where said information storing member of another ink cartridge of said plurality of ink cartridges is provided.

4. An ink jet printing apparatus as claimed in claim 3, wherein said information acquiring section further comprises a detecting section for determining whether or not each of said plurality of ink cartridges, in case of said plurality of ink cartridges, or each of said ink chambers of different colors, in case of said integrated ink cartridge, exists on a location facing said information storing member and said portion to be detected provided on each ink cartridge of said plurality of ink cartridges.

5. An ink jet printing apparatus as claimed in claim 2, wherein said information acquiring section detects said information storing members of said plurality of ink cartridges in a predetermined order, and said information storing member is provided at a location corresponding to a first location where said information storing member is detected.

6. An ink jet printing apparatus as claimed in claim 5, wherein said information acquiring section determines whether said ink cartridge contains separate ink cartridges or integrated ink cartridge, and said information acquiring section does not determine a next information storing member of a next ink chamber if the ink cartridge mounted is determined as having said integrated ink cartridge.

7. An ink jet printing apparatus as claimed in claim 2, wherein said information acquiring section connects to an information reading-out section, which reads out information from said information storing member of said plurality of ink cartridges, in parallel, and reads out and stores information on ink colors in each of said respective ink cartridges by using identification information on said ink colors.

8. An ink jet printing apparatus as claimed in claim 1, wherein said information acquiring section comprises an information reading-out section which reads out said information from said information storing member of said integrated ink cartridge in the same order as in case said information on ink of respective colors of said plurality of ink cartridges is read out.

9. An ink jet printing apparatus as claimed in claim 1, wherein said information acquiring section comprises a type determining section for determining whether said plurality of ink cartridges or said integrated ink cartridge is mounted.

10. An ink cartridge for an ink jet printing apparatus which prints in various colors of ink and is designed to mount thereon a plurality of separate ink cartridges each accommodating different color of ink, the ink cartridge comprising:

an integrated main body serving as one unit comprising a plurality of separate ink cartridges each accommodating therein a different color of ink; and an information storing member provided on said main body storing information corresponding to information comprised in all of the plurality of the separate ink cartridges, wherein said information storing member is provided at a location corresponding to a location where another information storing member of one of said plurality of separate ink cartridges is provided.

11. An ink cartridge as claimed in claim 10 further comprising a portion to be detected indicating that each of said ink chambers of respective colors is present, wherein said portion to be detected is provided at another location corresponding to a location where an additional information storing member of another ink cartridge of said plurality of ink cartridges is provided.

12. An ink cartridge as claimed in claim 10, wherein said location of said information storing member is provided at a position where said information storing member detected first.

13. An ink cartridge as claimed in claim 12, wherein said information storing member comprises information indicating that whether said ink cartridge equipped with said information storing member is one of said plurality of separate ink cartridges or said integrated ink cartridge.

14. An ink cartridge as claimed in claim 10, wherein said information storing member acquires and stores information on ink for each color by using identification information of ink of each color.

15. An ink cartridge as claimed in claim 14, wherein said information is acquired and stored by said information storing member in the same order as in case said information on ink of respective colors of said plurality of ink cartridges is read out.

16. An information storing member mounted on an integrated ink cartridge having a plurality of ink chambers for an ink jet printing apparatus which prints in various colors of ink and is designed to mount thereon a plurality of separate ink cartridges each accommodating a different color of ink, the information storing member comprising:

a memory device for storing information corresponding to information comprised in all of the plurality of the separate ink cartridges;

a terminal connecting to said memory device and communicating with an external device; and information indicating whether said ink cartridge equipped with said information storing member contains either one of said plurality of separate ink cartridges or said integrated ink cartridge, wherein an ink cartridge mounting section is capable of selectively and detachably mounting, individually, both of said plurality of separate ink cartridges or said integrated ink cartridge.

* * * * *